US005655460A

United States Patent [19]

Boonstra

[11] Patent Number: 5,655,460

[45] Date of Patent: Aug. 12, 1997

[54] INTERCONNECTIBLE SPACERS FOR SUPPORTING AN ARTICLE FROM A BASE SURFACE

[76] Inventor: Christopher R. Boonstra, 3330 32nd Ave., Hudsonville, Mich. 49426

[21] Appl. No.: 518,833

[22] Filed: Aug. 24, 1995

[51] Int. Cl.[6] ..... B65D 19/44

[52] U.S. Cl. ..... 108/55.3; 248/346.03; 446/120

[58] Field of Search ..... 108/54.1, 55.3, 108/55.1, 56.1, 51.1, 64; 248/346.03, 346.3, 558; 211/109; 446/120, 107

[56] References Cited

U.S. PATENT DOCUMENTS

| | | | |
|---|---|---|---|
| Re. 32,740 | 8/1988 | Steffes . | |
| D. 259,320 | 5/1981 | Tarozzi . | |
| D. 290,080 | 6/1987 | Carlson . | |
| D. 317,240 | 6/1991 | Bridges et al. . | |
| D. 328,689 | 8/1992 | Riskowski . | |
| 416,356 | 12/1889 | Clark . | |
| 438,391 | 10/1890 | Stone . | |
| 594,413 | 11/1897 | Medberry et al. . | |
| 1,074,453 | 9/1913 | Park . | |
| 1,186,418 | 6/1916 | Mischo . | |
| 1,745,556 | 2/1930 | Pendleton . | |
| 1,782,720 | 11/1930 | Franklin . | |
| 2,104,685 | 1/1938 | Wilson, Jr. . | |
| 2,302,639 | 11/1942 | Moore . | |
| 2,663,157 | 12/1953 | Laramy . | |
| 2,752,726 | 7/1956 | Calverley | 446/120 X |
| 3,359,756 | 12/1967 | Mirguet . | |
| 3,628,468 | 12/1971 | Angelbeck, Jr. . | |
| 3,636,888 | 1/1972 | Angelbeck, Jr. . | |
| 3,654,726 | 4/1972 | Witte | 446/120 X |
| 3,707,929 | 1/1973 | Lauffer . | |
| 4,071,244 | 1/1978 | Richards | 446/120 X |
| 4,255,944 | 3/1981 | Gardner et al. . | |
| 4,265,095 | 5/1981 | McConachie . | |
| 4,280,336 | 7/1981 | Taylor . | |
| 4,565,074 | 1/1986 | Morgan . | |
| 4,782,763 | 11/1988 | Salloum | 108/55.3 |
| 4,784,194 | 11/1988 | Danner | 108/55.3 X |
| 5,052,185 | 10/1991 | Spahr . | |
| 5,071,026 | 12/1991 | Apps . | |
| 5,231,789 | 8/1993 | Radmanovich . | |
| 5,249,699 | 10/1993 | Williams | 108/55.1 X |
| 5,257,509 | 11/1993 | Harris . | |
| 5,310,376 | 5/1994 | Mayuzumi et al. | 446/107 |
| 5,329,787 | 7/1994 | Friday . | |
| 5,353,607 | 10/1994 | McBride . | |
| 5,452,668 | 9/1995 | Hergeth et al. | 108/54.1 X |

FOREIGN PATENT DOCUMENTS

| | | | |
|---|---|---|---|
| 184028 | 11/1982 | Japan | 108/55.3 |

*Primary Examiner*—Jose V. Chen
*Attorney, Agent, or Firm*—Young & Basile P.C.

[57] ABSTRACT

An apparatus for separating and supporting an article from a base surface includes at least one spacer having a first surface engageable with the base surface, a second surface spaced from the first surface and engageable with the article to be supported, and a third surface extending between the first and second surfaces. The third surface defines coupling members or portions for releasibly interlocking adjacent spacers with respect to one another. The second surface can be defined by at least one elongated member having opposite ends formed to allow interconnection between identical spacers. The interconnection between the spacers can be accomplished by one end of the elongated member including a coupling member and the opposite end having a mating receiving member. An integral pedestal portion can be of sufficient length to separate the second surface and the article to be supported from any undesirable substance that is located on the base surface. The effective size of the second surface defined by the interlocking spacers may be varied by adding or removing individual spacers allowing substantially abutting engagement of the interconnected spacers against any confining surfaces.

21 Claims, 2 Drawing Sheets

INTERCONNECTIBLE SPACERS FOR SUPPORTING AN ARTICLE FROM A BASE SURFACE

FIELD OF THE INVENTION

The present invention relates to a spacer for supporting an article from a base surface, and more particularly, to interconnectible spacers capable of substantially conforming to any container size and configuration.

BACKGROUND OF THE INVENTION

Various types of trays, racks and shelves for ice chests have previously been proposed as evidenced by U.S. Pat. No. 5,052,185; U.S. Pat. No. 4,565,074; and U.S. Pat. No. Re. 32,740. It is also known to position perishable articles away from liquids to avoid saturation of articles, such as food goods. Each of the previously known trays, racks or shelves for ice chests are preformed into a specific unitary size to accommodate a particular ice chest configuration greatly limiting the adaptability to ice chest applications of different configurations.

SUMMARY OF THE INVENTION

It would therefore be desirable to manufacture a tray, rack or shelf that is readily adaptable to fit any size or configured area while maintaining an adequate space between the article and the supporting surface to avoid liquid saturation of the article. It would also be desirable for the rack, tray or shelf to have sufficiently strong structure to support a plurality of various articles. It would further be desirable for the tray, rack or shelf to be manufactured easily and efficiently. It is desirable to manufacture a tray, rack or shelf to be assembled, and installed by the end user without undue difficulty in any size or shape container.

It is desirable in the present invention to provide an apparatus for spacing and supporting articles from a base surface. The present invention is adaptable to substantially occupy or cover the dimensions and configurations of any adjacent confining surfaces, such as a container having a bottom and at least one peripheral side wall. The present invention is particularly well adapted for use in combination with a wide variety of configurations of portable ice chests or coolers. The present invention provides a spacer for separating and supporting articles from a base surface while adaptable sufficiently to substantially occupy areas of varying dimensions and configurations.

The apparatus according to the present invention includes at least one integrally-formed spacer having a support portion and a pedestal portion. Preferably, the spacer is made of plastic by injection molding, but may be made from other suitable materials and by other suitable processing methods. The support portion may include a plurality of integrally formed elongated members forming a surface for supporting an article. The supporting surface can provide openings to allow passage of liquid therethrough. Each elongated member may further include means for interconnecting additional spacers. The interconnecting means of the present invention can include two opposing members, where one member is engageable with the opposing member in a releasible interlocking manner. More specifically, the two opposing members of the interconnecting means can include a coupling portion and a receiving portion, the coupling portion can be integrally located at one end of each elongated member, and the receiving portion can be integrally located on the other end of each elongated member of the support portion of the spacer. The pedestal portion of the present invention can be integrally formed with the support portion. The pedestal portion can extend from the support portion at a predetermined angle with respect to the support surface, preferably normal thereto. The length of the base or pedestal portion is preferably sufficient to keep the supported article above liquid collected in the bottom of the container or the like. The pedestal portion may also include additional material in the form of ribs to strengthen and support the elongated members.

The apparatus according to the present invention can be a plurality of identical spacers, interconnecting with one another to form a support surface or grid that is separated from the base surface. The interconnecting means of individual identical spacers can include first and second interlocking portions having complementary surfaces engageable within one another. The positive connection between the first and second interlocking portions, such as a coupling portion and a receiving portion, of adjacent, identical spacers forms a structural joint between the adjacent spacers. The plurality of interconnecting spacers can be enlarged to occupy or cover a greater area by interconnecting additional spacers, or reduced in size or coverage by removing spacers. In essence, the article support can be adapted in size to occupy any size area and substantially abut against any confining surfaces. Additionally, an individual extension may be employed where a gap between the spacer and an adjacent side wall is formed having a dimension less than the corresponding dimension of a spacer. The extension member substantially fills the gap between the spacer and the confining side wall to further limit relative movement between the spacer and the side wall. The extension member may include at least one of the first and second interlocking portions for connecting to the spacer adjacent the confining side wall. The extension member can removably connect to the interconnected adjacent spacers via the interconnecting means.

Other objects, advantages and applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

Figure 1:
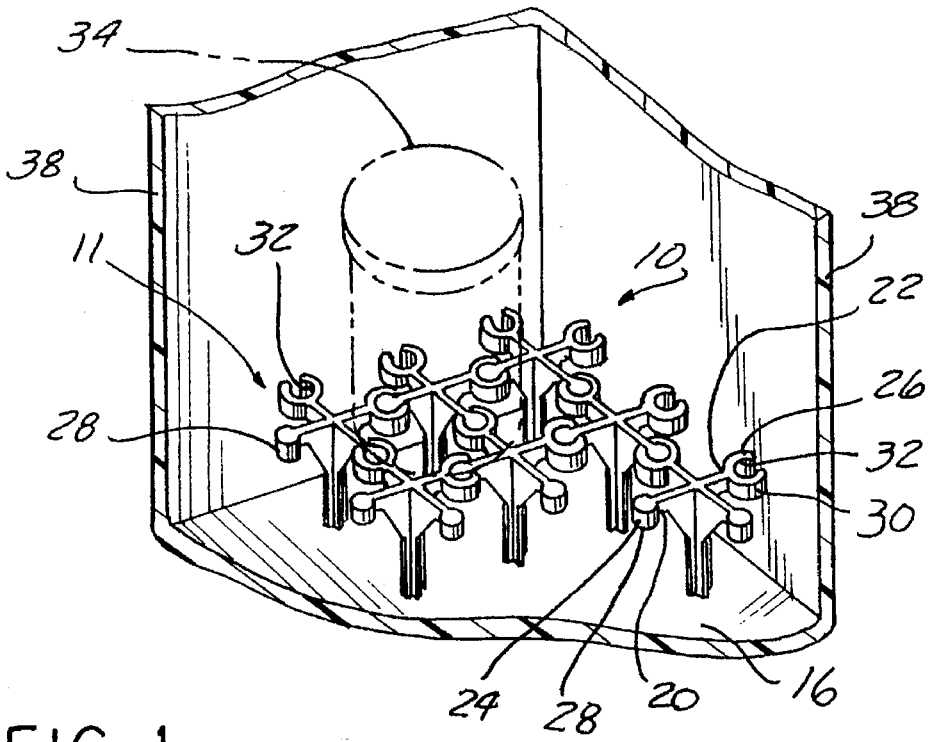
FIG. 1 is a perspective view of an apparatus according to the present invention with a plurality of identical, interconnected spacers supporting an article.
Figure 2:
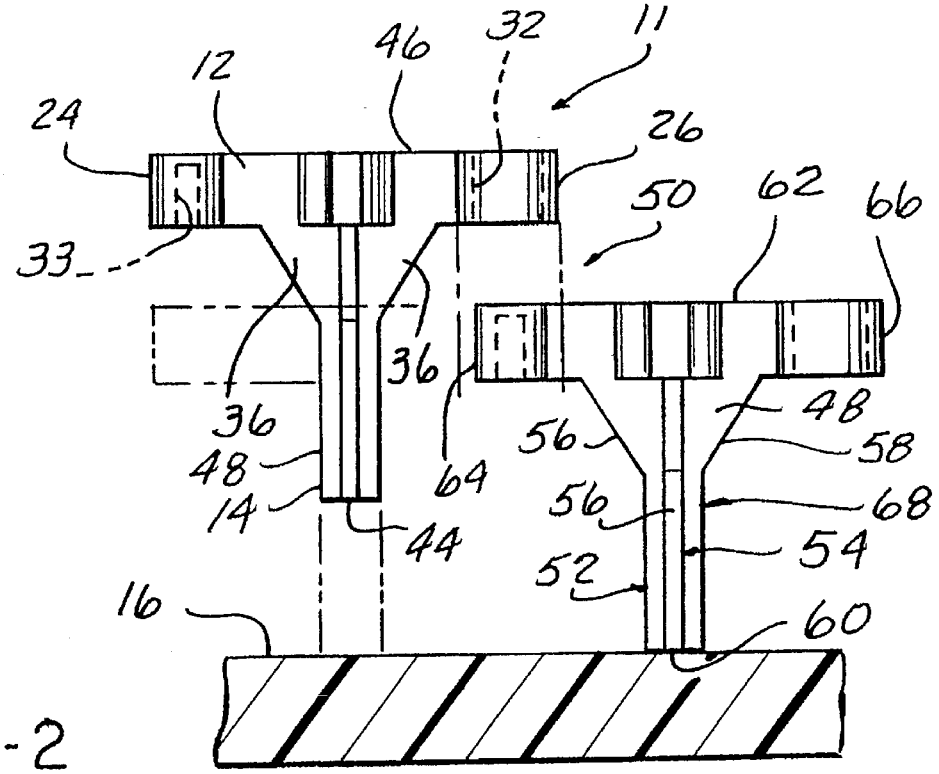
FIG. 2 is a side elevational view of a spacer according to the present invention for slidable interlocking engagement with another spacer, where the interconnected position is shown in phantom.

An apparatus 10 for supporting an article from a base surface, according to the present invention is illustrated in FIGS. 1–4. The apparatus 10 may include at least one spacer 11. The spacer 11 can include a support member or support portion 12 and an elongated pedestal or pedestal portion 14. The apparatus 10 is supported generally by engagement with a base surface 16. The support portion 12 may include a plurality of elongated members 18 disposed at predetermined angles from one another. Preferably, two elongated members are provided intersecting one another intermediate opposite ends thereof, and more preferably disposed generally bisecting one another at an angle of 90° with respect to one another. Each elongated member 18 has a first end 20 and a second end 22. Interconnecting means 23 is provided for removably attaching or interlocking identical spacers 11 to one another. The interconnecting means 23 may include a coupling portion or coupling member 24 and a receiving portion or receiving member 26. Each elongated member 18 preferably has a coupling portion or coupling member 24 at the first end 20, and a receiving portion or receiving member 26 at the second end 22. Preferably, coupling member 24 may take the form of an enlarged cylindrical portion or protuberance 28 and receiving member 26 may be defined by a side wall 30 defining a complementary cylindrical aperture with an open slot 32 formed in a portion of the side wall 30. The coupling portion 24 may include a bore 33 to reduce weight or for ease of manufacture. The coupling members 24 of spacer 11 may slidably engage within the receiving members 26 of adjoining spacers 11 to form an interconnected surface or grid for supporting articles 34 separated from base surface 16 as shown in FIG. 1. The elongated pedestal 14 can be integrally formed with the support member 12 of spacer 11. The pedestal 14 can extend outwardly from the elongated members 18 toward the base surface 16 at a predetermined angle. Preferably, elongated pedestal 14 includes a unitary projection and extends outwardly from the elongated members 18 normal to the grid surface, as best seen in FIG. 2. Elongated pedestal 14 is preferably of sufficient length to separate supported articles 34 from liquid or other materials that may be located on base surface 16. It should be understood that the number of elongated pedestals or projections, and the length thereof, may vary according to the specific application. Elongated pedestal portion 14 may include integral reinforcing ribs 36 to support elongated members 18. Preferably, reinforcing ribs 36 extend from each elongated member 18 and taper toward the elongated pedestal portion 14.

Figure 3:
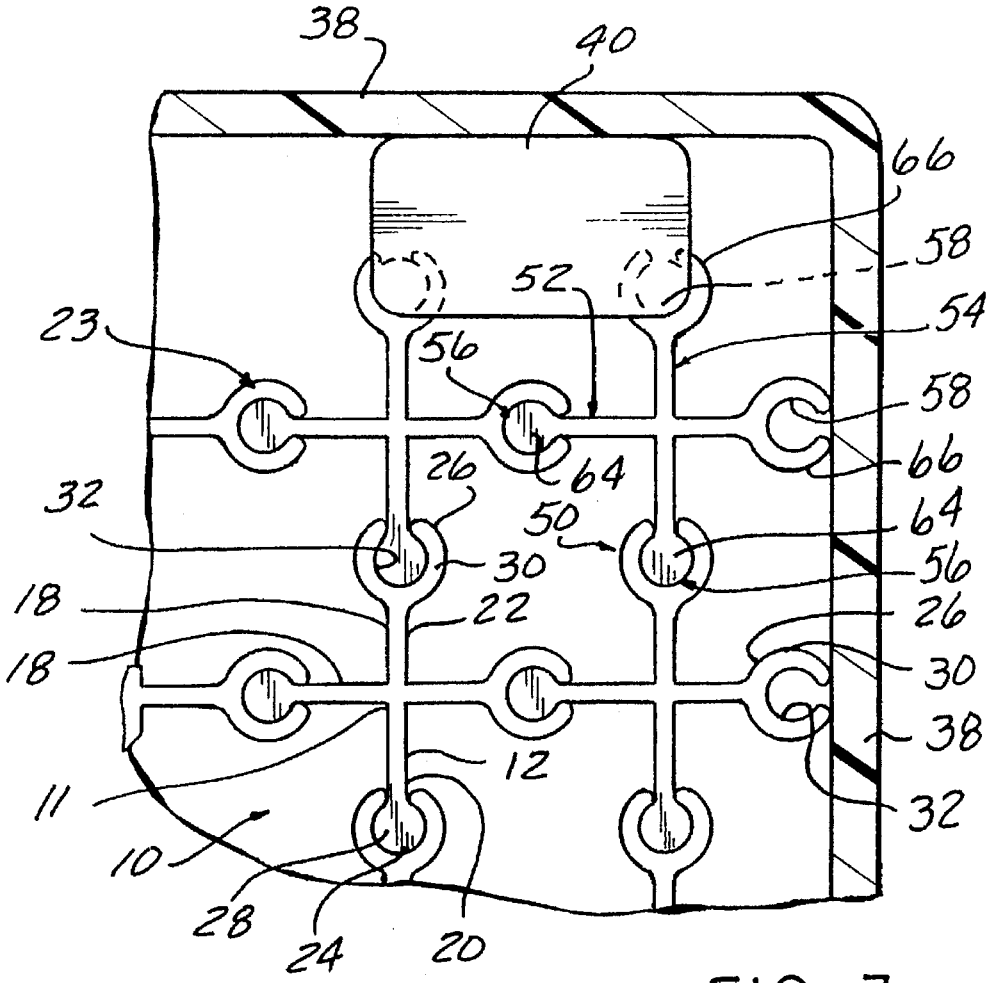
FIG. 3 is a plan view showing a plurality of interconnected spacers and an extension member attached thereto.
Figure 4:
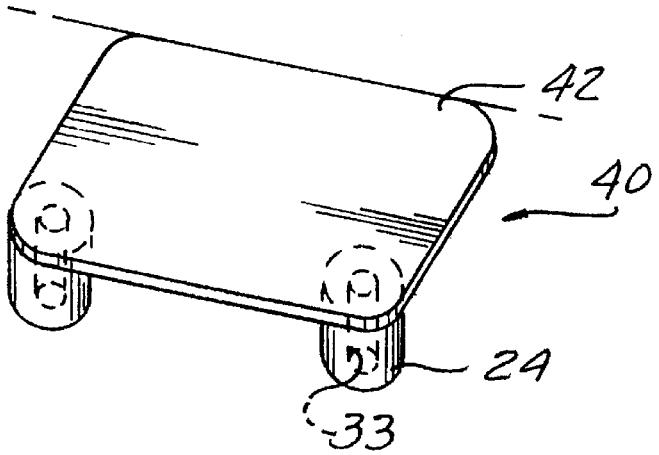
FIG 4 is a perspective view of an extension member showing the coupling members extending therefrom.

The apparatus 10 can be increased or decreased in size by adding or removing additional spacers 11 respectively to substantially occupy or conform to the dimensions of any adjacent or confining side wall surface 38 as best seen in FIGS. 1 and 3. Preferably, the apparatus 10 abuttingly engages any adjacent side wall surface 38 as seen in FIG. 3. An individual extension member 40 may be removably connected to adjoining spacers 11 to traverse a distance between coupling member 24 or receiving member 26 and any adjacent side wall surfaces 38. Preferably, extension member 40 includes two coupling members or coupling portions 24 integral with a plate 42. The extension member 40 interconnects receiving members 26 of adjoining spacers 11. The plate 42 may be of varying length, width and thickness. Preferably, the length is less than the length of elongated members 18 of spacer 11, and more preferably is approximately equal to one-half the length of elongated members 18, and most preferably is at most equal to one-half the length of the elongated members 18.

The apparatus 10 according to the present invention supports an article 34 from a base surface 16. The apparatus 10 can include a spacer 11 having a first surface 44 engageable with the base surface 16. A second surface 46 is spaced from the first surface 44 and is engageable with the article 34 to be supported. A third surface 48 extends between the first and second surfaces 44 and 46 respectively. Means 50 for releasibly interlocking with another adjacent spacer 11 is defined by the third surface 48.

In the preferred configuration, the apparatus 10 according to the present invention includes a plurality of identical, individual, one-piece spacers 11. Each spacer 11 has a first surface 44 engageable with the base surface 16, a second surface 46 spaced from the first surface and engageable with the article 34 to be supported, and a third surface 48 extending between the first and second surfaces 44 and 46 respectively. The first, second and third surfaces can be defined by first and second planar members, 52 and 54 respectively, disposed intersecting one another intermediate respective first and second generally vertically extending edges, 56 and 58 respectively. The first and second planar members, 52 and 54 respectively, are disposed generally perpendicular with respect to one another. A third edge 60 of the first and second planar members defines the first surface 44 engageable with the base surface 16. A fourth edge 62 of the first and second planar members defines the second surface 46 engageable with the article 34 to be supported. Each of the first and second planar members has an enlarged cylindrical portion 64 extending outwardly from the first edge 56 with an axis of the cylindrical portion 64 lying in a plane corresponding to the respective planar member. A complementary shaped cylindrical sleeve 66 extends outwardly from the second edge 58 for releasibly interlocking with a corresponding cylindrical portion 64 of a first edge 56 of an adjacent spacer 11. In the preferred embodiment, the axis of the cylindrical portion 64 extends generally normal with respect to the second surface 46. Each of the first and second planar members, 52 and 54 respectively, extend between the first and second surfaces, 44 and 46 respectively, and have a narrowed third edge 60 forming an elongated pedestal portion 68 engageable with the base surface 16 in the preferred embodiment. Each of the first and second planar members, 52 and 54 respectively, also preferably extend between the first and second surfaces, 44 and 46 respectively, and have an enlarged fourth edge 62 forming a grid-like second surface 46 engageable with the article 34 to be supported.

In summary, the present invention discloses an apparatus 10 for separating and supporting articles 34 from a base surface 16. The apparatus 10 may include a single spacer 11, or a plurality of identical spacers 11. Each spacer 11 has a single elongated member 18, or plurality of elongated members 18 and means for interconnecting to other identical spacers 11. The elongated member 18 may form an elongated pedestal 14. Preferably, spacer 11 is a one piece, integrally molded plastic member having a coupling member 24 integral on a first end 20 and a receiving member 26 integral on a second end 22 of each of two elongated members 18. Preferably, the elongated members 18 form an elongated pedestal 14 of sufficient length to separate articles 34 from base surface 16. The single spacers 11, or plurality of interconnected spacers 11, substantially occupy or cover an area between adjacent confining side wall surfaces 38.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. An apparatus for supporting an article comprising:

a spacer having a first surface, a second surface spaced from said first surface for engaging said article to be supported, and a third surface extending between said first and second surfaces along an external periphery of said spacer; and means, defined by said third surface formed integral with said spacer for releasibly interlocking with another adjacent spacer, said interlocking means including a coupling portion space from a complementary receiving portion, said coupling portion of one spacer releasibly connectible with said receiving portion of an adjacent spacer.

2. An apparatus for supporting an article comprising:

a spacer having a first surface, a second surface spaced from said first surface for engaging said article to be supported, and a third surface extending between said first and second surfaces along an external periphery of said spacer, each spacer having at least two elongated members positioned at a predetermined angle with respect to one another and an elongated pedestal portion, each of said elongated members having a first end and a second end; and means, defined by said third surface, for releasibly interlocking with another adjacent spacer, said means for releasibly interlocking including a coupling portion and a complementary receiving portion releasibly connectible with respect to an adjacent spacer, said coupling portion formed integral with said first end of each elongated member and said receiving portion formed integral with said second end of each elongated member.

3. The apparatus of claim 2 further comprising:

a plurality of identical, individual spacers removably connectible to one another by said interlocking means on said first and second ends of each elongated member.

4. The apparatus of claim 2 further comprising:

said coupling portion including an enlarged protuberance and said receiving portion including a side wall defining an open slot, said enlarged protuberance slidably engageable within said slot in said receiving portion.

5. The apparatus of claim 2 wherein said base surface is confined by at least one side wall, said apparatus further comprising:

extension means for removably connecting to said spacer by said interlocking means to substantially fill any gap existing between said side wall and said spacer.

6. An apparatus for supporting an article comprising:

a plurality of identical, individual spacers, each spacer having a first surface, a second surface spaced from said first surface for engaging said article to be supported, and a third surface extending between said first and second surfaces along an external periphery of said spacer, each spacer having a support portion with said second surface for engaging said article to be supported and an elongated pedestal portion with said first surface; and means, defined by said third surface, for releasible interlocking with another adjacent spacer, said interlocking means including at least one of a coupling portion and a complementary receiving portion releasibly connectible with respect to an adjacent spacer, said interlocking means, disposed on said support portion, for removably interconnecting adjacent spacers with respect to one another to form a grid surface spaced above said first surface and extendible substantially over a predefined area for supporting said article.

7. The apparatus of claim 6 further comprising:

said support portion having at least two elongated members, each elongated member having a first end and a second end, said elongated members disposed at a predetermined angle with respect to one another and forming said grid surface for supporting said article; and said interlocking means including a coupling portion and a receiving portion, said coupling portion formed integral with said first end of each elongated member and said receiving portion formed integral with said second end of each elongated member.

8. The apparatus of claim 7 further comprising:

said coupling portion including an enlarged protuberance.

9. The apparatus of claim 8 further comprising:

said receiving portion including a side wall defining an aperture having an inner periphery complementary to said enlarged protuberance of said coupling portion, said inner periphery further defining an open slot therethrough, said slot generally extending perpendicular to said grid surface defined by said elongated members, said enlarged protuberance of said coupling portion slidably engageable within said aperture of said receiving portion with one of said elongated members extending through said slot.

10. The apparatus of claim 6 further comprising:

said pedestal portion integral with said spacer and extending generally outwardly from said elongated members.

11. The apparatus of claim 6 further comprising:

extension means for filling a gap between said spacer and said at least one side wall, said extension means for releasibly interlocking with said spacer.

12. The apparatus of claim 11 further comprising:

said extension means including an individual extension member, said extension member removably connectible to at least one of said elongated members of said spacers by said interconnecting means, said extension member substantially abuttingly engages said at least one side wall.

13. An apparatus for supporting an article comprising:

a plurality of identical, individual spacers, each spacer having a support portion integral with an elongated pedestal portion, said support portion including a plurality of elongated members disposed at predetermined angles from one another forming a grid surface, each elongated member having a first end and a second end; and means for removably interconnecting individual spacers with one another, said interconnecting means including a coupling portion and a receiving portion, said coupling portion having an enlarged cylindrical protuberance integrally formed on a first end of each elongated member, said receiving portion having a side wall defining a complementary aperture to said coupling portion with an open slot therethrough extending generally perpendicular with respect to said grid surface, said coupling portion slidably engageable within said aperture of a receiving portion of an adjacent spacer with said connected elongated member extending through said slot, said pedestal portion extending generally perpendicularly from said grid surface.

14. The apparatus of claim 13 further comprising:

said pedestal portion including a plurality of tapered supporting ribs extending from said elongated members.

15. The apparatus of claim 13 further comprising:

a plurality of individual extension members, each extension member removably connectible to at least one of said spacers by said interconnecting means, said extension member positioned to extend said second surface outwardly beyond said third surface.

16. The apparatus of claim 15 further comprising:

said extension member having a plate with at least one coupling portion integrally formed thereon, said coupling portion of said plate slidable engageable within said aperture of said receiving portion of an adjacent spacer.

17. An apparatus for supporting an article comprising:

a plurality of identical, individual, one-piece spacers, each spacer having a first surface, a second surface spaced from said first surface for engaging said article to be supported, and a third surface extending between said first and second surfaces, said first, second and third surfaces defined by first and second planar members disposed intersecting one another intermediate respective first and second generally vertically extending edges, said first and second planar members disposed generally perpendicular with respect to one another, a third edge of said first and second planar members defining said first surface, and a fourth edge of said first and second planar members defining said second surface for engaging said article to be supported, each of said first and second planar members having an enlarged cylindrical portion extending outwardly from said first edge with an axis of said cylindrical portion lying in a plane corresponding to said respective planar member and a complementary shaped cylindrical sleeve extending outwardly from said second edge for releasibly interlocking with a corresponding cylindrical portion of a first edge of an adjacent spacer.

18. The apparatus of claim 17 further comprising:

said axis of said cylindrical portion extending generally normal with respect to said second surface.

19. The apparatus of claim 17 further comprising:

each of said first and second planar members extending between said first and second surfaces and having a narrowed third edge forming an elongated pedestal.

20. The apparatus of claim 17 further comprising:

each of said first and second planar members extending between said first and second surfaces and having an enlarged fourth edge forming a grid-like surface engageable with said article to be supported.

21. An apparatus for supporting an article comprising:

a container having a base surface and at least one side wall, said container for receiving at least one article therein;

a plurality of spacers, each spacer having a first surface engageable with said base surface of said container, a second surface spaced from said first surface for engaging said article to be supported spaced from said base surface and confined by said at least one side wall of said container, and a third surface extending between said first and second surfaces along an external periphery of said spacer; and means, defined by said third surface, for releasibly interlocking with another adjacent spacer, said interlocking means including at least one of a coupling portion and a complementary receiving portion releasibly connectible with respect to an adjacent spacer.

* * * * *